United States Patent [19]

Yakushiji et al.

[11] 3,980,838

[45] Sept. 14, 1976

[54] PLURAL ELECTRET ELECTROACOUSTIC TRANSDUCER

[75] Inventors: Nobuo Yakushiji, Yokohama; Kenji Suehiro, Kawasaki, both of Japan

[73] Assignee: Tokyo Shibaura Electric Co., Ltd., Kawasaki, Japan

[22] Filed: Feb. 14, 1975

[21] Appl. No.: 549,928

[30] Foreign Application Priority Data

| | | |
|---|---|---|
| Feb. 20, 1974 | Japan | 49-20160 |
| Feb. 20, 1974 | Japan | 49-20162 |
| Aug. 31, 1974 | Japan | 49-100062 |

[52] U.S. Cl. ..... 179/111 E

[51] Int. Cl.[2] ..... H04R 19/00

[58] Field of Search ..... 179/111 R, 111 E

[56] References Cited

UNITED STATES PATENTS

| | | | |
|---|---|---|---|
| 3,118,979 | 1/1964 | Sessler et al. | 179/111 R |
| 3,136,867 | 6/1964 | Brettell | 179/111 R |
| 3,821,492 | 6/1974 | Tamura et al. | 179/111 E |
| 3,894,198 | 7/1975 | Murayama et al. | 179/111 E |
| 3,896,274 | 7/1975 | Fraim et al. | 179/111 E |

FOREIGN PATENTS OR APPLICATIONS

| | | | |
|---|---|---|---|
| 832,276 | 4/1960 | United Kingdom | 179/111 E |
| 801,352 | 9/1958 | United Kingdom | 179/111 R |

*Primary Examiner*—George G. Stellar
*Attorney, Agent, or Firm*—Oblon, Fisher, Spivak, McClelland & Maier

[57] ABSTRACT

An electrostatic type electroacoustic transducer includes a stationary electrode having a rear electrode, a pair of electret films formed one at each side of the rear electrode, and a plurality of through holes. A pair of movable electrodes are each disposed, through a respective spacer, on the electret film bearing stationary electrode in a manner to confront the electret film. Acoustic signal voltage is supplied between the movable electrodes.

6 Claims, 14 Drawing Figures

SINGLE TYPE (PRIOR ART)

PUSH-PULL TYPE (PRIOR ART)

TWIN SINGLE TYPE (THIS INVENTION)

PLURAL ELECTRET ELECTROACOUSTIC TRANSDUCER

This invention relates to an electroacoustic transducer and, in particular, to a twin single type electroacoustic transducer.

Conventionally known are a single type electroacoustic transducer having a stationary electrode plate bored with a plurality of through holes and a movable electrode plate disposed opposite to the stationary electrode plate with a spacing left therebetween, and a push-pull type electroacoustic transducer having a pair of stationary electrode plates bored with a number of holes and a movable electrode plate disposed between the paired stationary electrode plates with a spacing left between the movable electrode and the stationary electrode.

With the single type electroacoustic transducer, all signal voltage applied between the stationary electrode plate and the movable electrode plate acts as a driving force to the movable electrode plate i.e. the electrode diaphragm. As a result, a good sound converting efficiency can be obtained with a great sound pressure. Since, however, the electrode diaphragm is vibrated in such a state that it is always attracted toward the stationary electrode plate under the influence of an electrostatic force induced by a bias voltage, the amplitude of the electrode diaphragm is narrowed and the stiffness of the electrode diaphragm becomes greater. For this reason, the transducer of this type can not be used in a device for generating low and medium frequency sounds having great amplitude and, moreover, no good linearity is obtained over the whole compass of the sound. This provides a cause for increased distortion.

With the push-pull type electroacoustic transducer, on the other hand, the electrode diaphragm can be vibrated at a center position between the paired stationary electrode plates, since electrostatic forces induced at the paired stationary electrode plates due to the bias voltage are cancelled with respect to each other. According to the push-pull type transducer, such drawbacks as encountered in the single type transducer can be eliminated and distortion can be alleviated to a maximum possible extent. Since, however, signal voltage is applied between the paired stationary electrode plates, it acts on the electrode diaphragm as if divided into halves. As a result, a sound converting efficiency is lowered and no great sound pressure can be obtained.

With the single type and the push-pull type transducer, a protective film is additionally required to make the stationary electrode plate moistureproof and dustproof. With a transducer equipped with an electret bearing stationary electrode, the protective film is absolutely required to maintain the characteristic of the electret excellent. The provision of the protective film, however, complicates the structure of the transducer and, furthermore, produces unwanted resonances, thereby impairing a sound converting characteristic.

It is accordingly the object of this invention to provide an electroacoustic transducer which is capable of obtaining a great sound pressure as well as alleviating distortion to a considerable extent and can obviate the necessity of providing any protective film.

According to this invention, a pair of electrode diaphragms are disposed one at each side of a stationary electrode plate with a predetermined spacing left between the stationary electrode plate and the electrode diaphragm. A pair of electret films are provided one on the inner surfaces of the electrode diaphragms or one on those surfaces of the stationary electrode which confronts the inner surfaces of the electrode diaphragms. The diaphragms are vibrated in the same direction and acoustically coupled to each other.

This invention can be more fully understood from the following detailed description when taken in conjunction with the accompanying drawings, in which.

Figure 1:
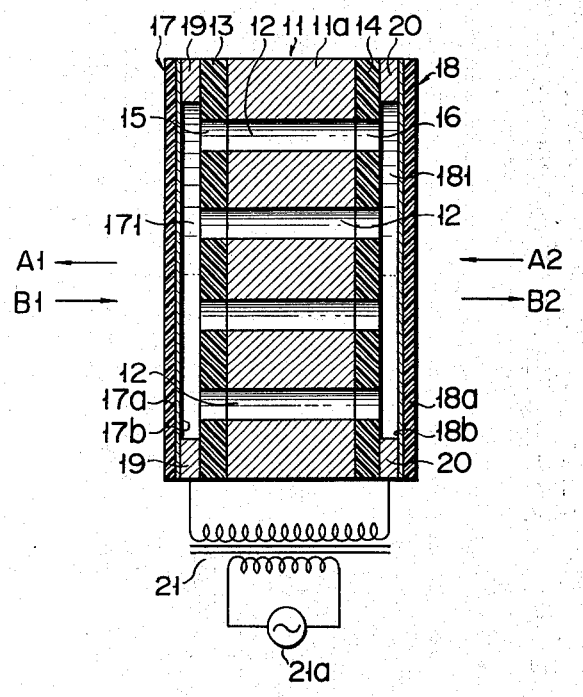
FIG. 1 is a cross-sectional view showing an electroacoustic transducer according to one embodiment of this invention.

Referring to FIG. 1, a stationary electrode plate 11 comprises a rear electrode plate 11*a* and a pair of electret films 13 and 14. The rear electrode plate 11*a* is made of, for example, a circular aluminium plate of 0.3 mm in thickness and several centimeters in diameter and has a great number of through holes 12 having a diameter of about 1.5 mm. A sum of the areas of the through holes 12 amounts to about 30% of the area of the surface of the stationary electrode plate. The electret films 13 and 14 are formed one at each face of the rear electrode plate 11*a*. The electret film is formed by electrically charging a Teflonseries high-molecular film of 130$\mu$ in thickness and has holes 15 and 16 each of which communicates with the through holes 12 of the rear electrode plate 11*a*. A pair of movable electrode plates, i.e. electrode diaphragms 17 and 18, are disposed one at the side of the electret film 13 and the other at the side of the electret film 14 so that the stationary electrode plate 11 is sealed. Ring-like spacers 19 and 20 of 50$\mu$ in thickness, which are each made of a copper foil, are disposed one between the electret film 13 and the electrode diaphragm 17 and one between the electret film 14 and the electrode diaphragm 18, leaving sealed chambers 171 and 181, respectively. The sealed chambers 171 and 181 communicate with each other through the through holes 12 of the stationary electrode plate 11 and, in consequence, the electrode diaphragms 17 and 18 are acoustically coupled to each other. The electrode diaphragm 17 (or 18) comprises a polyester series high-molecular film 17*a* (or 18*a*) of 4$\mu$ and a 1$\mu$ thick electroconductive film 17*b*

(or 18*b*) made of, for example, an aluminium foil and formed on the inner surface of the film 17*a* (or 18*a*). The electrode diaphragms 17 and 18 correspond in size to the stationary electrode. These numerical values are ones applied to an element for a tweeter speaker. To the aluminium foils 17*b* and 18*b* of the electrode diaphragms 17 and 18 is supplied acoustic signal voltage appearing at a secondary winding of a boosting transformer 21 having a primary winding connected to a singal source 21*a*. For ease in understanding the nature of the invention some parts of the transducer of FIG. 1 are dimensionally exaggerated as required. The same thing can be made of the following embodiments.

With the electrostatic type electroacoustic transducer so arranged, when the electret films 13 and 14 have a negative charge (about 1000V), the electroconductive films 17*b* and 18*b* of the electrode diaphragms 17 and 18 which confront the electret films 13 and 14, respectively, are charged to a positive state. Since the electret films 13 and 14 are made of insulating material, the stationary electrode is electrically insulated from the electrode diaphragms 17*b* and 18*b* irrespective of the presence of electroconductive spacers 19 and 20. Upon supplying sound signal voltage from the boosting transformer 21 through the spacers 19 and 20 to the electrode diaphragms 17 and 18, the positive charge at the side of the electrode diaphragm 17 is intensified for a positive half cycle of alternating current and the electrode diaphragm 17 is attracted in a direction indicated by an arrow B1 in FIG. 1. On the other hand, the positive charge at the side of the electrode diaphragm 18 is weakened and the electrode diaphragm 18 is repulsed in a direction indicated by an arrow B2 in FIG. 1. During the negative half cycle of the alternating current the electrode diaphragm 17 is repulsed in a direction indicated by an arrow A1 and the electrode diaphragm 18 is attracted in a direction indicated by an arrow A2. In this way, both the electrode diaphragms 17 and 18 are vibrated, for each one half cycle of the sound signal, in the same direction and acoustically coupled through the through hole 12 to each other. As a result, the sound signal is transformed into sound pressure i.e. sound.

The above-mentioned electroacoustic transducer is different in principle from a conventional single type or push-pull type one. That is, it exhibits characteristics near to the single type transducer, viewed from the standpoint of sound pressure, and characteristics near to the push-pull transducer, viewed from the standpoint of distortion. Consequently, the transducer of this invention has the merits of the single and push-pull type transducers in common and is referred to hereinafter as a "twin single type transducer". To explain in more detail, the sound pressure $|P|$ of the electrostatic type electroacoustic transducer in general will be generally expressed as follows:

$$|P| = \frac{\omega \rho o a^2}{2r} \cdot \frac{Co^2}{\epsilon o S} \cdot \frac{EoE_1}{ZM_1} \qquad (1)$$

in which $\omega$: angular frequency
$\rho o$: medium density
$Co$: electrostatic capacity
$a$: radius of a vibrating system
$\epsilon o$: vacuum dielectric constant
$S$: area of the vibrating system $r$: distance measured from the front axis
$Eo$: polarized voltage (bias voltage)
$E_1$: applied AC voltage
$ZM_1$: effective mechanical impedance (including the vibrating system, air load, negative stiffness)

With the constant term of the equation (1) represented by $$K = \frac{\rho o a^2 \cdot Co^2 \cdot EoE_1}{2r \cdot \epsilon EoS} \qquad (2)$$

The constant $K$ is based on the electrostatic capacity $Co$ when the electrode diaphragm is not attracted by the polarized voltage toward the stationary voltage, and it is applied to the push-pull type transducer. Where use is made of the single type or twin single type transducer in which the electrode diaphragm is attracted by the polarized voltage toward the stationary electrode, the electrostatic capacity becomes greater than $Co$ and its constant $K'$ becomes greater than $K$.

At $Ka < 1$ ($K = \omega/C = 2\pi f/C$ in which $C$ denotes sound speed) and $f > fo$ ($fo$ denotes resonance frequency), the effective mechanical impedance of the equation (1) is changed dependent upon the angular frequency so that the relation $$ZM_1 = (M + 2Ma)\cdot\omega$$

is established with respect to the mass $M$ of the electrode diaphragm as will be later described. In the case of the single, push-pull, and twin single type transducers, it follows from the equation (1) that the respective sound pressures $|Ps|$, $|Pp|$ and $|Pt|$ will be $$|Ps| = K' \frac{1}{M + 2 \times 3 \cdot 2a^3} \qquad (3)$$

$$|Pp| = K \frac{1}{M + 2 \times 3 \cdot 2a^3} \qquad (4)$$

$$|Pt| = K' \frac{1}{M + 3 \cdot 2a^3 + \pi a^2 \rho o d} \qquad (5)$$

in which $d$ denotes a distance between the electrode diaphragms.

Since $K' > K$, it follows that $|Ps| > |Pp|$. Considered from the object of this invention, the expression $$|Pt| \sim |Ps| > |Pp| \text{ i.e. } |Pt| > |Pp|$$

must be proved.

Suppose that $d$ of the equation (5) is selected to have a normal value of $2 \sim 3 \times 10^{-3}(m)$. Then, $3 \cdot 2a^3 > \pi \cdot a^2 \cdot \rho o \cdot d$.

Upon comparison between the equations (4) and (5) it will be appreciated that $|Pp| > |Pt|$. Where, for example, use is made of a diaphragm having a vibrating area of $6 \times 10^{-4}(m^2)$, a density of 1.4 and a thickness of $4\mu$, $|Pt| / |Pp| \doteqdot 1.7$ (under the identical conditions it is equivalent to an excess of 4.6dB).

From this, $$|Pt| \sim |Ps| > |Pp| \text{ i.e. } |Pt| > Pp$$

is proved. Since with the twin single type transducer of this invention one electrode diaphragm is repulsed outwardly while the other electrode diaphragm is contacted with the stationary electrode plate, the sound converting characteristic is not greatly varied. Consequently, the distance $d$ between the electrode diaphragm and the stationary electrode plate can be infinitely reduced. Since, in the conventional single type and push-pull type transducer, the electrode diaphragm is so arranged as not to be contacted with the stationary electrode plate, the distance $d$ can not be reduced to less than a predetermined value. According to this invention, therefore, a great sound pressure can be obtained as compared with the conventional transducer.

Figure 2A:
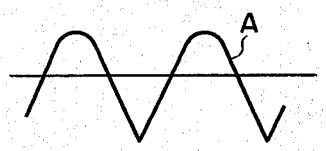
FIGS. 2A to 2C show oscillating waves.
Figure 2B:
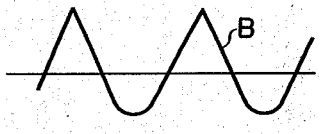
Figure 2C:
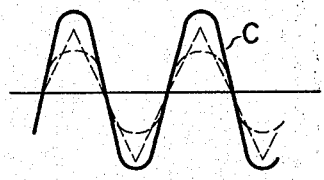

With the electrostatic type electroacoustic transducer, the driving power shows square characteristics and a problem arises as to a second harmonic distortion in particular. The second harmonic distortion D of the single type transducer will be expressed as follows:

$$D = \frac{Z' m'}{Z \cdot Z' m^2} \cdot \frac{E_1}{Eo} \times 100\ [\%] \qquad (6)$$

when $E_1 = 160V$ and $Eo = 1000V$ at $Ka < 1$ and $fo < f$, a distortion factor will be 3.3%. Where with the push-pull type transducer a driving force acting on the electrode diaphragm is completely balanced, even-order harmonics including a second harmonic are theoretically cancelled. As a result, the distortion factor will become substantially zero. In the twin single type transducer of this invention, the vibrating system is completely balanced. When a distance between the electrode diaphragms is small, the distortion factor wil theoretically become substantially zero as in the case of the push-pull type transducer. Distortion occurs due to a difference in the amplitude of the electrode diaphragm between the case where the electrode diaphragm is attracted toward the stationary electrode plate and the case where the electrode diaphragm is repulsed away from the stationary electrode plate. Since, in the single type transducer, such an amplitude difference appears as acoustic output, a great distortion is involved. According to the push-pull transducer, on the other hand, such amplitude difference is cancelled and a distortion is reduced to an extent as near to zero as possible. With the twin single type transducer of this invention the two electrode diaphragms are disposed one at each side of the stationary electrode plate and acoustically coupled to each other so that they can be vibrated in the same direction. In this case, an amplitude difference between the individual electrode diaphragms is cancelled and a distortion is alleviated to as small an extent as possible. FIGS. 2A–2C show the state in which the distortion is alleviated. Suppose that a sinusoidal wave signal is supplied between the two electrode diaphragms. Then, one of the electrode diaphragms is repulsed, for one half cycle of the sinusoidal wave signal, away from the stationary electrode plate and attracted, for the remaining half cycle of the sinusoidal wave signal, toward the stationary electrode plate, thereby obtaining a distorted waveform A as shown in FIG. 2A. The waveform A of the signal is overshot during the remaining half cycle. On the other hand, the other electrode diaphragm is attracted, for said one half cycle of the signal, toward the stationary electrode plate and repulsed, for said remaining half cycle thereof, away from the stationary electrode plate, thereby obtaining a distorted waveform B as shown in FIG. 2B. The waveform B of the signal is overshot during said one half cycle. Since, however, these electrode diaphragms are acoustically coupled to each other through the through hole of the stationary electrode plate, the waveforms A and B are combined together to form a distortion-free waveform, as shown in FIG. 2C, which is faithful to the supplied signal. Viewed from the mathematical viewpoint, the oscillatory wave of one electrode diaphragm can be briefly expressed as:

$$f_1(t) = \sin t + K(\sin t)^2$$

and the oscillatory wave of the other electrode diaphragm can be briefly expressed as:

$$f_2(t) = -\sin t + K(\sin t)^2$$

(These expressions are obtained by picking up important terms through Fourier expansion.)

The oscillatory waves of these diaphragms, when combined together, can be expressed as follows:

$$f(t) = f_1(t) - f_2(t) = \sin t + K(\sin t)^2 - \left\{-\sin t + K(\sin t)^2\right\} = 2\sin t$$

From this expression it will be evident that the combined osciallatory waves are entirely free from second harmonic distortion and sound pressure is elevated to a maximum possible extent.

Figure 3A:
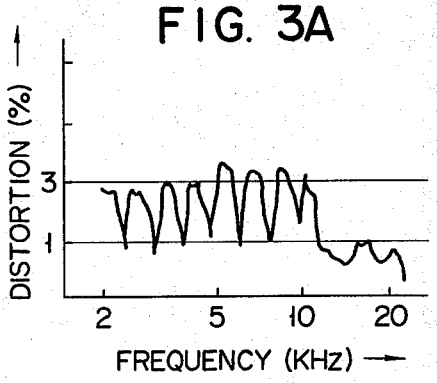
FIGS. 3A and 3B are curves showing the distortion characteristic and sound pressure characteristic of a single type transducer.
Figure 3B:
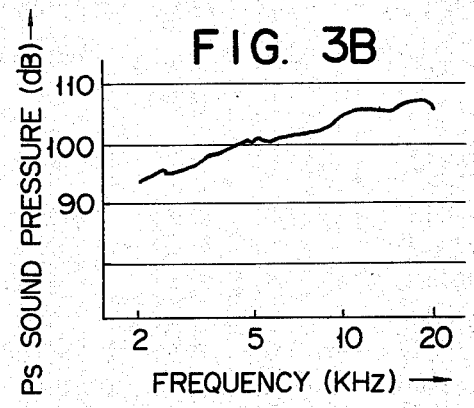
Figure 4A:
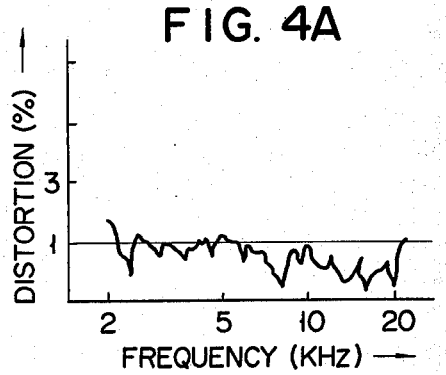
FIGS. 4A and 4B are curves showing the distortion characteristic and sound pressure characteristic of a push-pull type transducer.
Figure 4B:
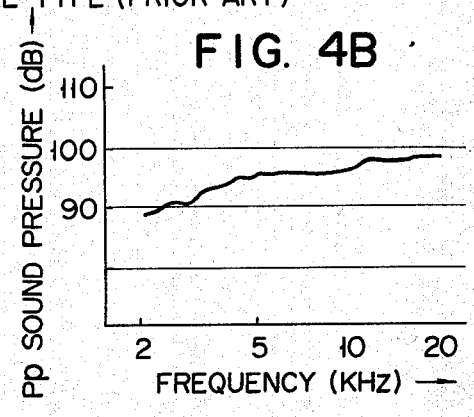
Figure 5A:
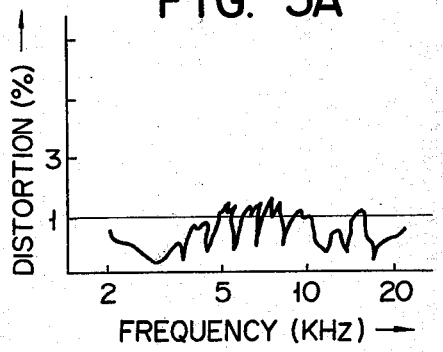
FIGS. 5A and 5B are curves showing the distortion characteristic and sound pressure characteristic of a twin single type transducer according to this invention.
Figure 5B:
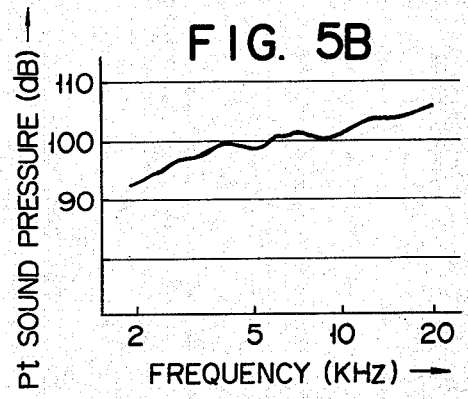

FIGS. 3A–3B show the distortion characteristic and sound pressure characteristic of the single type transducer; FIGS. 4A–4B show the distortion characteristic and sound pressure characteristic of the push-pull type transducer; and FIGS. 5A and 5B show the distortion characteristic and sound pressure characteristic of the twin single type transducer. In these Figures, the distortion was measured using a measuring device so set that the same output level is obtained at the frequency of 10 kHz. The distortion characteristic, if represented as distortion factor, is more than 3% in the case of the single type transducer and less than about 1% in the case of the push-pull type and twin single type transducers. The sound pressure as shown in FIGS. 3–5 was measured at the same input power level. From these Figures it will be evident that $$|P_t| \sim |P_s| > |P_p|$$

As will be clear from the above-mentioned characteristic diagrams, the twin single transducer is excellent with respect to the distortion and sound pressure.

Since according to this invention the stationary electrode having the electret films 13 and 14 formed one at each side thereof is sealed by the electrode diaphragms 17 and 18, this obviates the necessity of providing any protective film for the electret as required for the conventional transducer. As a result, the transducer of this invention can be made simple in structure. Furthermore, there occurs no unwanted resonance due to the presence of the protective film and, in consequence, a faithful or hi-fi sound reproduction can be effected without impairing the sound converting characteristic. In consequence, the transducer of this invention is very suitable for a speaker of a stereo-player etc.

Figure 6:
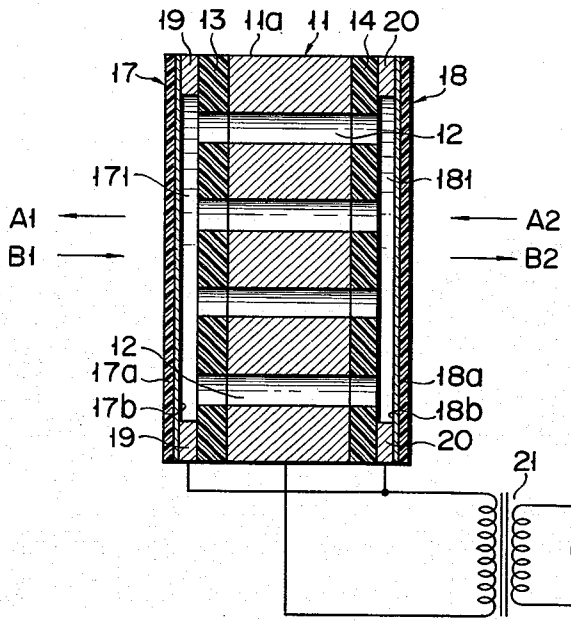
FIG. 6 is a cross-sectional view showing another embodiment of the electroacoustic transducer according to this invention in which sound signal is supplied between the electrode diaphragm and stationary electrode.

FIG. 6 shows another embodiment of this invention. In this embodiment, electret films 13 and 14 have a different polarity charge. A secondary winding of a transformer 21 has one end connected in common with electrode diaphragms 17 and 18 and the other end connected with a stationary electrode plate 11. The same reference numerals are employed throughout the specification to designate parts and elements corresponding to those shown in FIG. 1.

Suppose, for example, that the electret film 13 is charged to a positive state and the electret film 14 is charged to a negative state. Then, electroconductive films 17*b* and 18*b* of the electrode diaphragms 17 and 18 are charged negative and positive, respectively. Upon supplying AC signal between the electrode diaphragms 17 and 18 and the stationary electrode, the negative charge of the electrode diaphragm 17 is cancelled during the positive half cycle of the signal and the electrode diaphragm 17 is repulsed in a direction indicated by an arrow A1, while the positive charge of the electrode diaphragm 18 is intensified and the electrode diaphragm 18 is attracted in a direction indicated by an arrow A2.

During the negative half cycle of the AC signal, on the other hand, the electrode diaphragm 17 is attracted in a direction indicated by an arrow B1 and the electrode diaphragm 14 is repulsed in a direction indicated by an arrow B2. In this way, the electrode diaphragms 17 and 18 are vibrated, in the same direction, at an amplitude corresponding to the level of the AC signal. With such electroacoustic transducer, one of the electret films 13 and 14 which are charged positive and negative, respectively, is intensified for each half (position or negative) cycle of the AC signal. For this reason, the repulsion force acting between the stationary electrode plate and the electrode diaphragm becomes great as compared with the attraction force acting between the stationary electrode plate and the electrode diaphragm. Consequently, the transducer can obtain sound pressure about double that of the first-mentioned transducer. With the electroacoustic transducer of this type in which the amplitude of the electrode diaphragm is smaller in the repulsion direction than in the attraction direction, the difference of the amplitude is compensated for and the distortion due to the amplitude difference is alleviated to a maximum possible extent.

Figure 7:
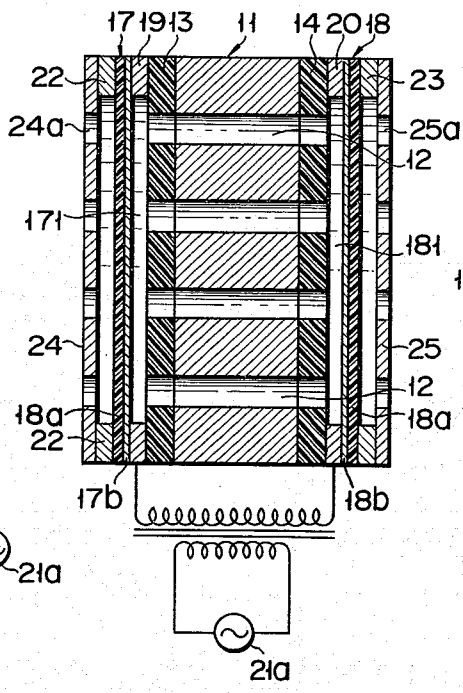
FIG. 7 is a cross-sectional view showing a modified electroacoustic transducer in which a pair of distortion-correcting plates are disposed.

When the electroacoustic transducer of FIGS. 1 and 6 is in a static state or no signal is supplied to the electroacoustic transducer, the electrode diaphragms 17 and 18 of the transducer are held in a stable state in which they are attracted by an electrostatic force toward the stationary electrode 11. The vibrating system, when completely balanced in such a stable state, theoretically provides no cause for distortion. In actual practice, however, it is very difficult to make the vibrating system completely balanced. In this sense, the vibrating system is, even when in the stable state, subjected to a certain extent of distortion. To completely avoid such a distortion two magnetically charged distortion-correcting plates 24 and 25 having holes 24*a* and 25*a*, respectively, are disposed, as shown in FIG. 7, one outside of the electrode diaphragm 17 and the other outside of the electrode diaphragm 18. Spacers 22 and 23 having a predetermined thickness are sandwiched one between the electrode diaphragm 17 and the distortion-correcting plate 24 and the other between the electrode diaphragm 18 and the distortion-correcting plate 25. In this electrode case, magnetic force acts between the distortion-correcting plate and the electrode diaphragm so as to oppose an electrostatic power acting, during the static time, to attract the electrode diaphragm toward the stationary electrode 11. As a result, the electrode diaphragm is balanced between the distortion-correcting plate and the stationary electrode in a manner that it is stably maintained in a neutral state, and occurrence of distortion is, therefore, prevented. Though with this embodiment two distortion-correcting plates 24 and 25 are provided, only one distortion-correcting plate may be disposed outside of the electrode diaphragm 17 or 18.

Figure 8:
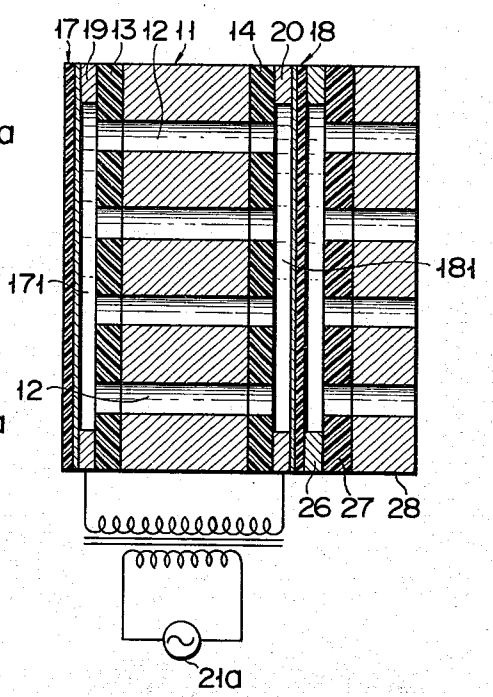
FIG. 8 is a cross-sectional view showing a further modification in which a distortion-correcting plate bearing an electret film is disposed.
Figure 9:
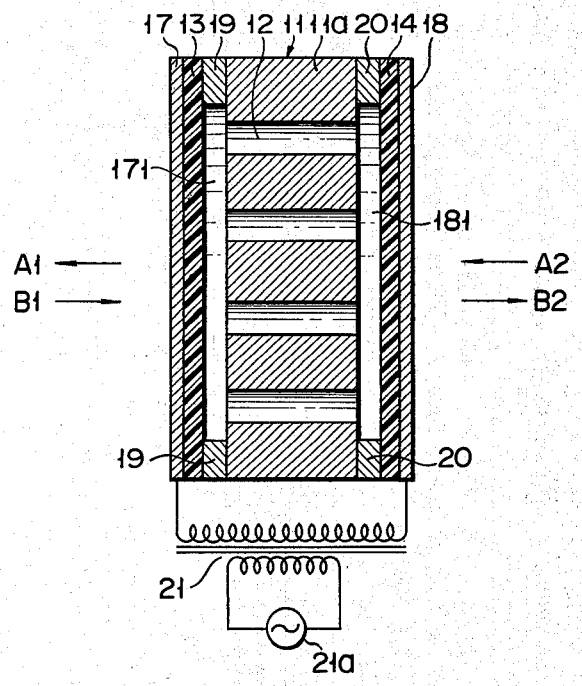
FIG. 9 is a cross-sectional view showing another embodiment of the electroacoustic transducer in which an electret film is disposed on each of the electrode diaphragms.

FIG. 8 shows another modified transducer as designed to obtain a distortion correcting effect. Outside of the electrode diaphragm 17 or 18 (in this case, 18) a distortion-correcting plate 28 having an electret 27 opposed to the electrode diaphragm 18 is arranged through a spacer 26 having a predetermined width. During the static period, electrostatic force acts equally at each side of the electrode diaphragm 18 and, in consequence, the electrode diaphragm 18 is balanced between the stationary electrode plate 11 and the distortion-correcting plate 28 in a manner to be stably maintained in a neutral state, thereby preventing occurrence of distortion. Though with the above-mentioned embodiments the paired electret films 13 and 14 are formed one on the opposite surfaces of the stationary electrode 1 so as to provide a bias electrostatic charge, they may be formed one on the inner surfaces of the electrode diaphragms 17 and 18 as shown in FIG. 9. In this case, the electret film is bonded on that surface of the electrode diaphragm which confronts the stationary electrode plate, and protected in an air-tight fashion from the outer atmosphere. Also the electrode diaphragms 17, 18 are each formed of conductive material only. This makes it easy to make an electrical connection to the secondary winding of the transformer 21.

As explained above, it is possible according to this invention to provide an electrostatic type electroacoustic transducer which is featured by its greater sound pressure and less distortion. The transducer of this type can be used particularly as a tweeter speaker.

The embodiments corresponding to FIGS. 7 and 8 may be applied to the transducer of FIG. 6.

What we claim is:

1. An electroacoustic transducer comprising a stationary electrode plate including a plate-like rear electrode; a pair of electret films superposed one on each side of the rear electrode and having a plurality of through holes; a pair of electrode diaphragms disposed one at each side of the stationary electrode, spaced at a predetermined interval from each of those surfaces of the stationary electrode plate which confront the electrode diaphragms, respectively, and acoustically coupled to each other through the through holes of the stationary electrode; the electrets being charged to opposite polarities with respect to each other and an output signal of a signal source being supplied between each of the diaphragms and the rear electrode with one end of the signal source being electrically connected in common with the pair of electrode diaphragms and the other end connected with the stationary electrode plate.

2. An electroacoustic transducer according to claim 1 wherein a distortion correcting plate is further disposed at a predetermined interval at least at a side on which one of the diaphragms is disposed.

3. An electroacoustic transducer according to claim 2 wherein the distortion correcting plate has an electret film opposed to the diaphragm.

4. An electroacoustic transducer according to claim 1 wherein the diaphragms each comprise, an electrically conductive film facing the electret and a polyester-based high molecular film disposed on the conductive film.

5. An electroacoustic transducer according to claim 4 wherein a pair of spacers are interposed, in air-tight fashion, one between each of the diaphragms and each surface of the stationary electrode plate.

6. An electroacoustic transducer according to claim 5 wherein the spacers are made of copper foil.

* * * * *